United States Patent [19]

Bordes

[11] 4,182,253

[45] Jan. 8, 1980

[54] DRILLING VESSEL WITH HANDLING MEANS FOR DRILLING PIPE

[75] Inventor: Kees Bordes, Maasland, Netherlands

[73] Assignee: N.V. Industrieele Handelscombinatie Holland, Rotterdam, Netherlands

[21] Appl. No.: 958,992

[22] Filed: Nov. 9, 1978

Related U.S. Application Data

[63] Continuation of Ser. No. 805,104, Jun. 9, 1977, abandoned.

[30] Foreign Application Priority Data

Jun. 10, 1976 [NL] Netherlands ..... 7606280

[51] Int. Cl.[2] ..... B63B 25/00

[52] U.S. Cl. ..... 114/72; 212/18; 414/140

[58] Field of Search ..... 114/72, 73, 260; 414/745, 139, 140; 212/3, 18

[56] References Cited

U.S. PATENT DOCUMENTS

| | | | |
|---|---|---|---|
| 673,622 | 5/1901 | Moore | 212/18 |
| 1,084,630 | 1/1914 | Hawthorn | 214/15 R |
| 2,113,712 | 4/1938 | Robinson | 212/18 |
| 2,711,707 | 6/1955 | Seitzman | 114/16 R |
| 3,389,809 | 6/1968 | Wilson | 212/18 |
| 3,727,776 | 4/1973 | Meeusen | 214/14 |

*Primary Examiner*—Charles E. Frankfort

*Attorney, Agent, or Firm*—Young & Thompson

[57] ABSTRACT

A drilling vessel has a hold adapted to store and transport drilling pipes arranged parallel to the length of the vessel. An elevator extends lengthwise of the vessel in the mid-plane of the hold and communicates between a plurality of superposed holds and the deck. An elongated overhead crane that extends longitudinally of the vessel is arranged in the or each hold, the crane being supported at its ends on tracks extending transversely of the hold located fore and aft of the hold. These tracks are interrupted at their middle for vertical passage of the ends of the elevator. The ends of the elevator, in turn, ride on vertical tracks that are interrupted for passage of the ends of the cranes. In this way, the elevator can move vertically and the cranes traverse horizontally, without interfering with each other.

2 Claims, 6 Drawing Figures

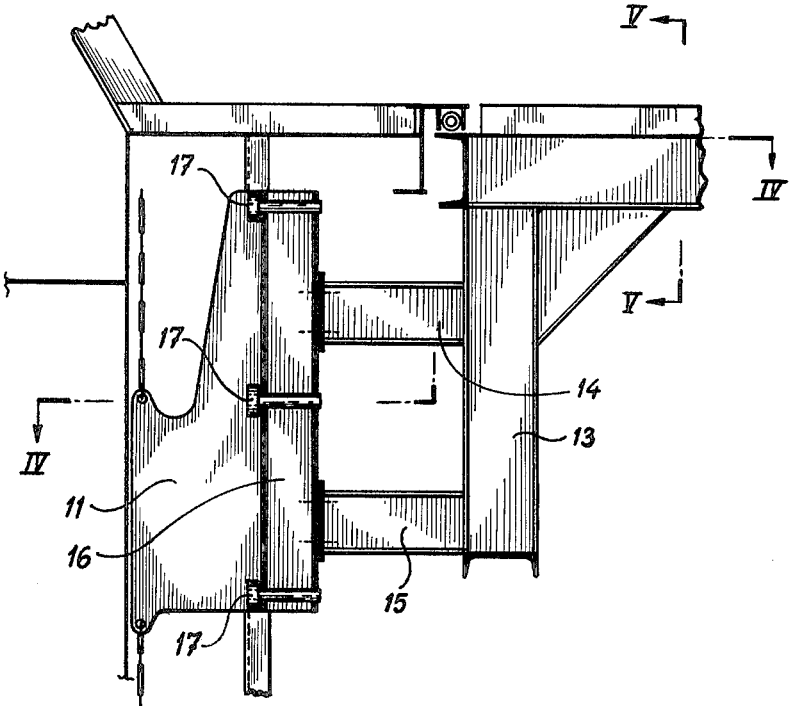
fig-3
fig-4
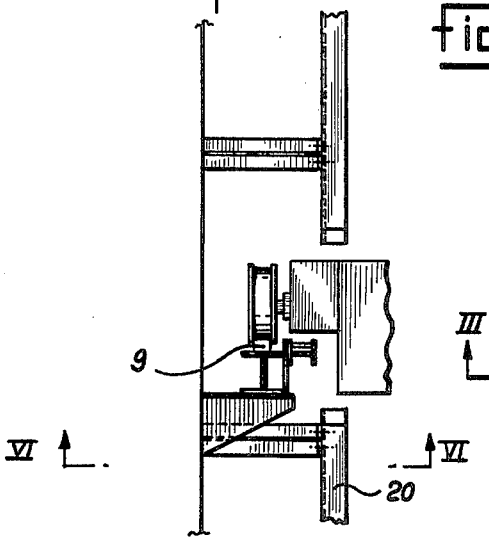
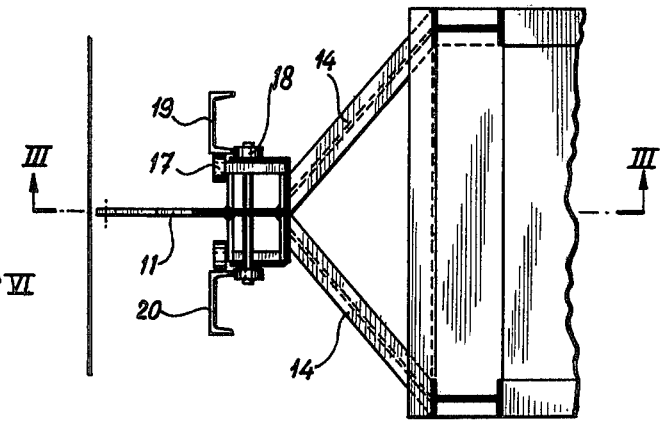

DRILLING VESSEL WITH HANDLING MEANS FOR DRILLING PIPE

This is a continuation of application Ser. No. 805,104, filed June 9, 1977, now abandoned.

The invention relates to a drilling vessel provided with a hold for storing drilling pipes therein and with means for carrying these pipes from the hold to the deck and from there to a device by which the horizontally disposed pipe can be lifted and finally put into the derrick in a vertical position, which hold is provided with an overhead crane. Such drilling vessel is generally known.

In the known drilling vessel the drilling pipes are carried from the hold with the aid of a deck mounted crane and taken to the ramp with the aid of which the drill pipes are put in an upstanding position into the derrick. This is a cumbersome procedure; moreover these operations are subject to the influences of the weather conditions and therefore these operations have to be interrupted if the weather conditions are bad.

The object of the invention is to improve these operations. This object is attained in that according to the invention the piping hold is provided with a piping elevator disposed in the longitudinal centre plane of the vessel and formed as a longitudinal plate member or beam acting as a pipe carrier, of which the ends are connected to vertically extending guiding members of which the guiding tracks traverse the travelling tracks of the overhead crane.

By this piping elevator it is possible to lift a pipe put on the elevator by an overhead crane, up to a level from which the pipe can be carried into the derrick via a ramp.

In a vessel having two superimposed piping holds the guiding track of the piping elevator extends over the full height of both holds and is interrupted only at the position of the travelling tracks of the overhead cranes of each hold.

Preferably the piping elevator is arranged so that it may be locked in the uppermost position in order to serve as a hatch.

The invention will now be described in more detail by referring to the drawings.

FIG. 3 shows the lefthand upper portion of FIG. 2 in a cross section along the line III—III in FIG. 4 and FIG. 5 respectively.

FIG. 4 shows a cross-section along the line IV—IV in FIG. 3.

Figure 1:
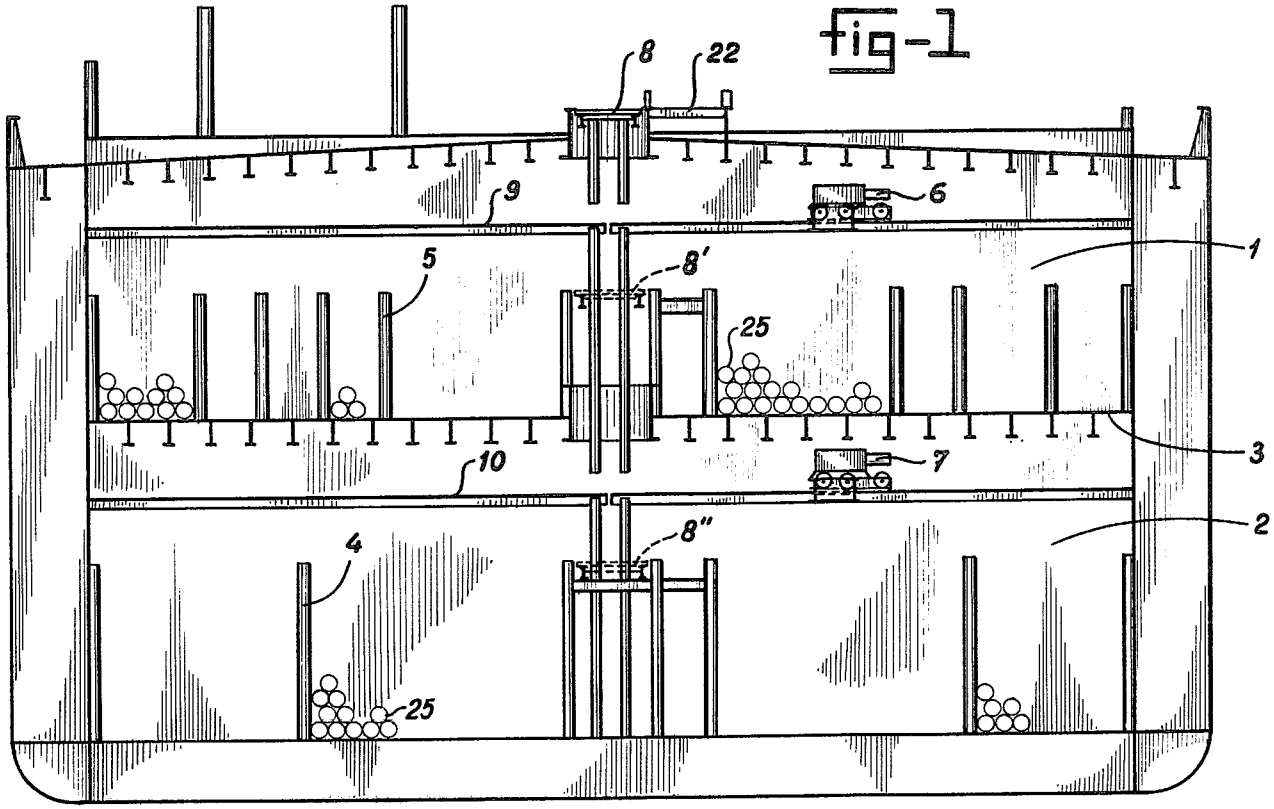
FIG. 1 shows a cross-section through a drilling vessel at the location of the piping holds.

As shown in FIG. 1 the vessel has two superimposed holds 1 and 2 separated from each other by a deck 3.

In these holds, by the supporting poles 4 and 5 the spaces are delimited in which the pipes 25 extending in the longitudinal direction of the vessel are stored.

In each hold an overhead crane 6 and 7 respectively is provided through which pipes can be carried away from the storing racks and taken to a piping elevator 8 which is shown in FIG. 1 by full lines in the uppermost position and in the intermediate take-up positions 8', 8" by chain lines.

Figure 2:
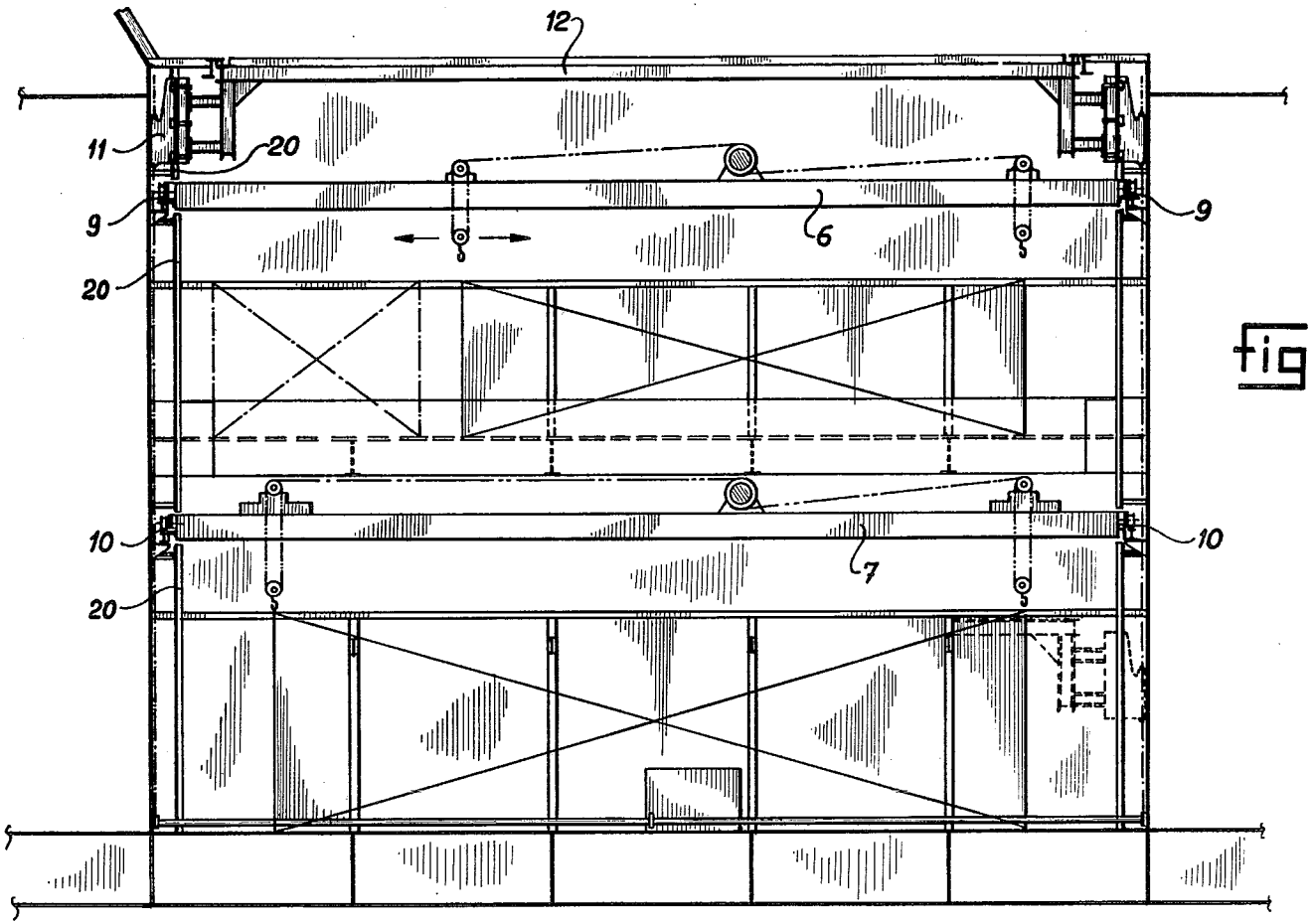
FIG. 2 shows a longitudinal cross-section through the piping holds.

The overhead crane 6 travels along a travelling track 9 and the overhead crane 7 along a travelling track 10. These travelling tracks are situated at both ends of the holds 1 and 2, as shown in FIG. 2.

The travelling tracks 9 and 10 are interrupted at the middle portions over a distance sufficiently large for passing a plate member 11. Such gap can be bridged in a known way, for instance by arranging the travelling device with three travelling wheels so that in passing the gap there is always a support by two wheels.

The piping elevator comprises a platform 12 supported at its ends by beams 13, 14 and 15 which in turn support a vertical portion 16 provided with three sets of travelling wheels 17, 18 which cooperate with vertically extending guiding tracks 19 and 20 which at the positions of the tracks 9 and 10 respectively of the overhead cranes are interrupted over such distance that the overhead cranes are permitted to pass the guiding tracks 19 and 20. On the portion 16 a plate member 11 is provided with which the operating means of the piping elevator are connected. Thus the track of the overhead cranes is interrupted only over a very small distance 21 (FIG. 6).

Figures 5, 6:
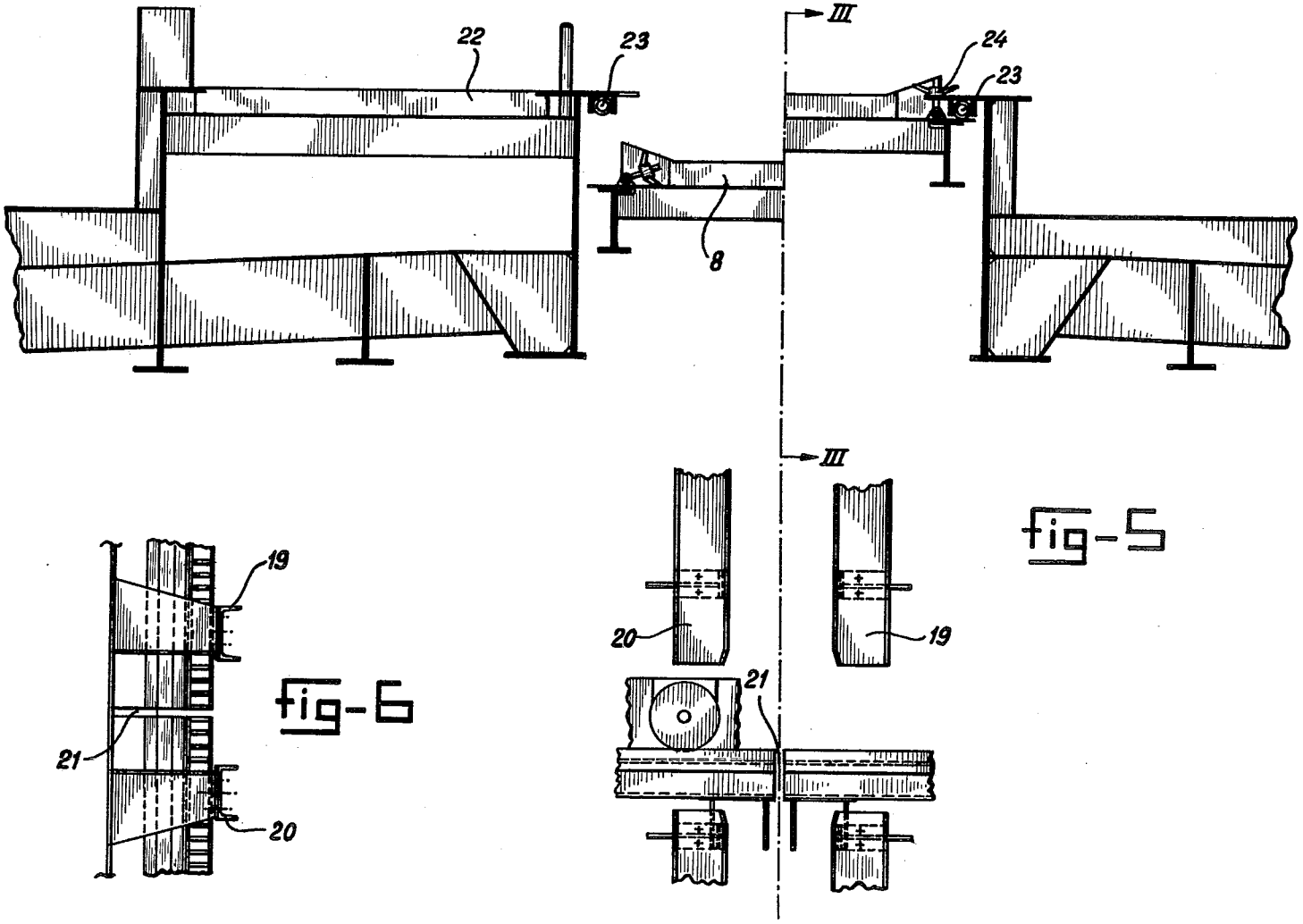
FIG. 5 shows a cross-section along the line V—V in FIG. 3.
FIG. 6 shows a cross-section along the line VI—VI in FIG. 3.

As shown in FIGS. 1 and 5 beside the piping elevator 8 in its uppermost position a receiving surface 22 is provided. Further as shown in FIG. 5 the piping elevator 8 is arranged for bearing against sealing means 23 in its uppermost position, in which position the elevator may be fastened by locks 24 so that the piping elevator may serve as a hatch.

I claim:

1. A drilling vessel having a hold, that extends transversely thereof for substantially the entire width of said vessel, for storing drilling pipes horizontally therein with the pipes extending parallel to the length of the vessel, an elevator for moving pipes into and out of said hold, said elevator being disposed in the longitudinal center plane of the vessel and extending lengthwise of the vessel, vertically disposed guide members fore and aft of the hold for guiding the ends of the elevator vertically, an overhead crane for loading and unloading pipes on said elevator and moving pipes in said hold, said crane extending lengthwise of the vessel in the hold and supported at its ends on horizontal tracks that extend transversely of the hold for substantially the entire width of said hold and are disposed fore and aft of the hold, said horizontal tracks being interrupted at their midportions adjacent the longitudinal center plane of said vessel and the ends of said elevator being movable vertically through said interrupted midportions of said tracks.

2. A drilling vessel as claimed in claim 1, said vertical guide members being interrupted at the level of said crane for horizontal passage of said crane therethrough.

* * * * *